United States Patent [19]

Gay et al.

[11] Patent Number: 4,893,827

[45] Date of Patent: Jan. 16, 1990

[54] CHAIR CONSTRUCTION FOR INCAPACITATED PERSONS

[75] Inventors: Dwight S. Gay, Fenton; John W. Hoornstra, Vassar, both of Mich.

[73] Assignee: Gunnell, Inc., Vassar, Mich.

[21] Appl. No.: 238,861

[22] Filed: Aug. 31, 1988

[51] Int. Cl.[4] ..... A61G 5/00

[52] U.S. Cl. ..... 280/250.1; 297/327; 297/416; 297/435

[58] Field of Search ..... 280/250.1; 297/327, 297/328, 359, 416, 435, 410

[56] References Cited

U.S. PATENT DOCUMENTS

| | | | |
|---|---|---|---|
| 2,448,860 | 9/1948 | Collins | 297/327 X |
| 2,918,964 | 12/1959 | Braun | 297/435 X |
| 2,986,200 | 5/1961 | Nobile | 297/327 |
| 3,174,800 | 3/1965 | Jennings | 297/416 |
| 3,198,575 | 8/1965 | Hawkins | 297/328 |
| 3,993,351 | 1/1976 | Rodaway | 297/416 |
| 4,170,368 | 10/1979 | Southward et al. | 280/250.1 |
| 4,264,085 | 4/1981 | Volin | 280/304.1 |
| 4,272,210 | 1/1984 | Wevers | 280/304.1 |
| 4,375,295 | 3/1983 | Volin | 280/304.1 |
| 4,489,955 | 12/1984 | Hamilton | 280/250.1 |
| 4,500,102 | 2/1985 | Haury et al. | 297/DIG. 4 |
| 4,506,903 | 3/1984 | Bowermaster | 280/304.1 |
| 4,515,385 | 5/1985 | Christian | 280/304.1 |
| 4,530,122 | 7/1985 | Sanders et al. | 5/83 |
| 4,553,770 | 11/1985 | Lyman | 280/304.1 |
| 4,598,921 | 7/1986 | Fenwick | 280/242 WC |

FOREIGN PATENT DOCUMENTS

| | | | |
|---|---|---|---|
| 2029334 | 3/1980 | United Kingdom | 297/327 |
| 2158350 | 11/1985 | United Kingdom | 297/435 |

*Primary Examiner*—John A. Pekar

*Attorney, Agent, or Firm*—Learman & McCulloch

[57] ABSTRACT

A chair for use by an incapacitated person has a wheeled frame which carries a body support assembly composed of a seat, a back, and a foot rest. The back is angularly adjustable relative to the seat and the foot rest is angularly adjustable relative to the seat. The body support assembly is rockable as a unit relative to the frame to enable the entire assembly to occupy any one of a member of tilted positions. The body support assembly may be removed as a unit from the frame for use as a car seat or the like.

31 Claims, 5 Drawing Sheets

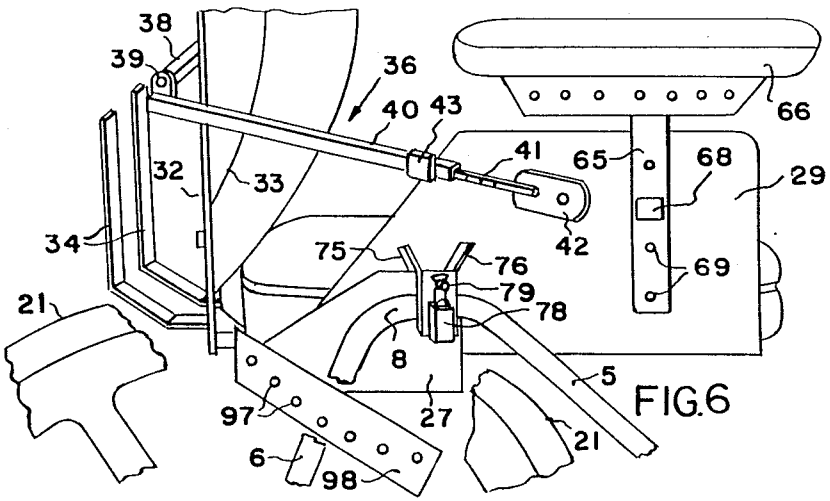
FIG.6
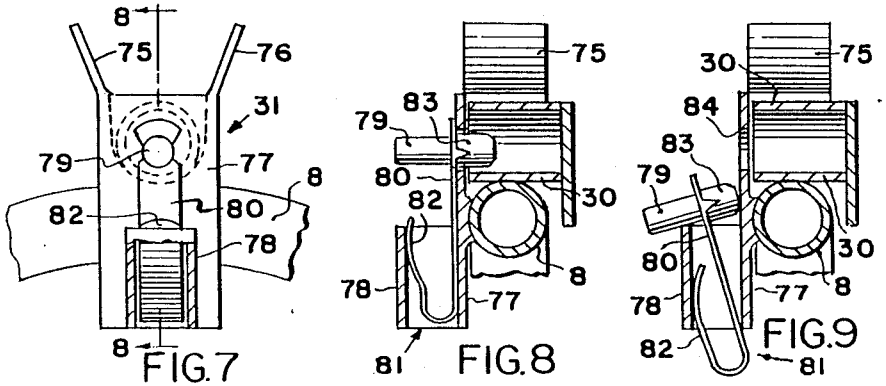
FIG.7
FIG.8
FIG.9
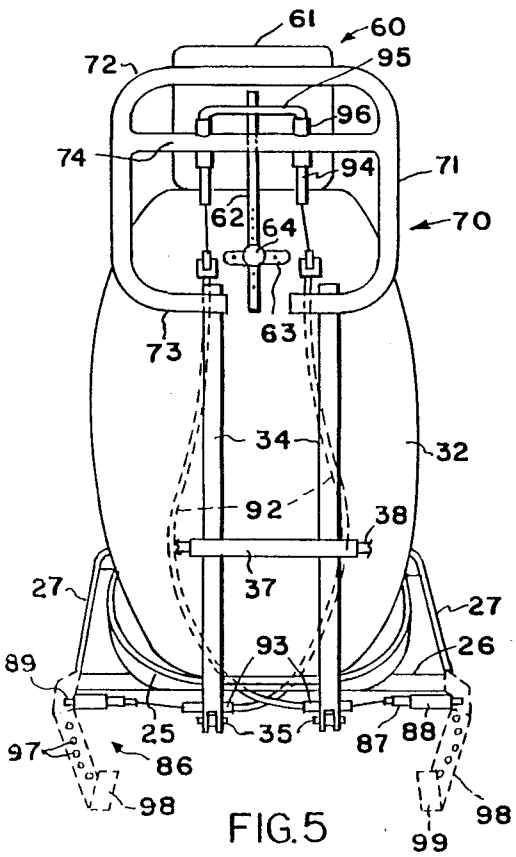
FIG.5

CHAIR CONSTRUCTION FOR INCAPACITATED PERSONS

CHAIR CONSTRUCTION FOR INCAPACITATED PERSONS

This invention relates to a chair construction especially adapted for use by incapacitated persons, such chairs commonly being referred to as wheelchairs.

BACKGROUND OF THE INVENTION

A conventional wheelchair has a frame equipped with front and rear wheels and a body support composed of a seat member, a back member, and one or two foot rest members. It is conventional to provide for vertical adjustment for the foot rest member so as to enable persons of different height to use the same chair comfortably. Some wheelchairs in use heretofore also have provided a hinged or pivotal coupling between the seat and back members to enable the back member to be adjusted from a substantially vertical position to a rearwardly inclined position. Although such wheelchairs have many desirable attributes, those available heretofore have been inadequate to meet the needs of many handicapped persons.

It is not uncommon for a handicapped person to have hip or knee flexion limitations which produce unwanted reflex patterns if the angle between the spine and hip or between the hip and knee is not confined to one within the flexion limitations. Not all of the presently available wheelchairs can accommodate these limitations.

It often is desirable to adjust or tilt the body supporting members of a wheelchair so as to make a person more comfortable, and without changing the angular relationships between the person's back, upper legs, and knees. No known wheelchair is capable of functioning in this manner.

Some persons require a chair that is more or less custom fitted to their needs. However, the acquisition of custom fitted chairs for a large number of persons can cause financial hardship to the persons and/or to institutions which they may be required to attend. For example, a handicapped person often must travel by car to doctors'offices, hospitals, therapists'offices, schools, and the like. It is desirable that any especially fitted chair construction for any such person be capable of being removed from its wheeled frame, when desired, so as to facilitate its use when the person is travelling or attending one of the abovementioned offices or institutions. Known wheelchairs, however, are incapable of accommodating this objective.

An object of the present invention is to provide a chair construction which overcomes the problems referred to above.

SUMMARY OF THE INVENTION

A chair constructed in accordance with the preferred embodiment of the invention comprises a frame on which is mounted a pair of swivelable forward wheels and a pair of larger rearward wheels. Mounted on the frame is a body support comprising a seat member, a back member, and a foot rest member. The back member is hinged to the seat member to enable the back member to be moved from a generally vertical position to a rearwardly inclined position, and the foot rest is connected to the seat member in such manner as to enable the foot rest to be adjusted vertically and, also, to be swung about an axis to enable the occupant's knees to flex.

In addition to the ability of the seat member, back member, and foot rest to be adjusted relatively to one another, all of such members may be adjusted bodily as a unit relatively to the frame so as to enable the entire assembly to be rocked about a substantially horizontal axis, thereby enabling a person occupying the chair to assume any selected one of a number of different tilted positions.

The assembly of the seat, back, and foot rest members may be removed as a result from the frame. Such assembly, when removed from the frame, may function as a car seat or a floor seat.

The relatively large, rear wheels are adjustable fore and aft of the frame to provide a stable supporting base for the parts of the chair assembly when the back member is tilted rearwardly. The large rear wheels also are removable from the frame to facilitate transport of the chair in a conventional automobile.

THE DRAWINGS

A preferred embodiment of the invention is illustrated in the accompanying drawings, wherein:

FIG. 5 is a rear elevational view of the seat and back members removed from the frame;

FIG. 6 is a fragmentary, side elevational view on an enlarged scale illustrating certain details;

FIG. 7 is a fragmentary, enlarged, side elevational view, partly in section, illustrating the manner in which the body support may be removably retained on the frame;

FIG. 8 is a transverse sectional view taken on the line 8—8 of FIG. 7 and illustrating the retaining means in one position;

FIG. 9 is a view similar to FIG. 8, but illustrating the retaining means in an adjusted position;

DETAILED DESCRIPTION

Figure 1:
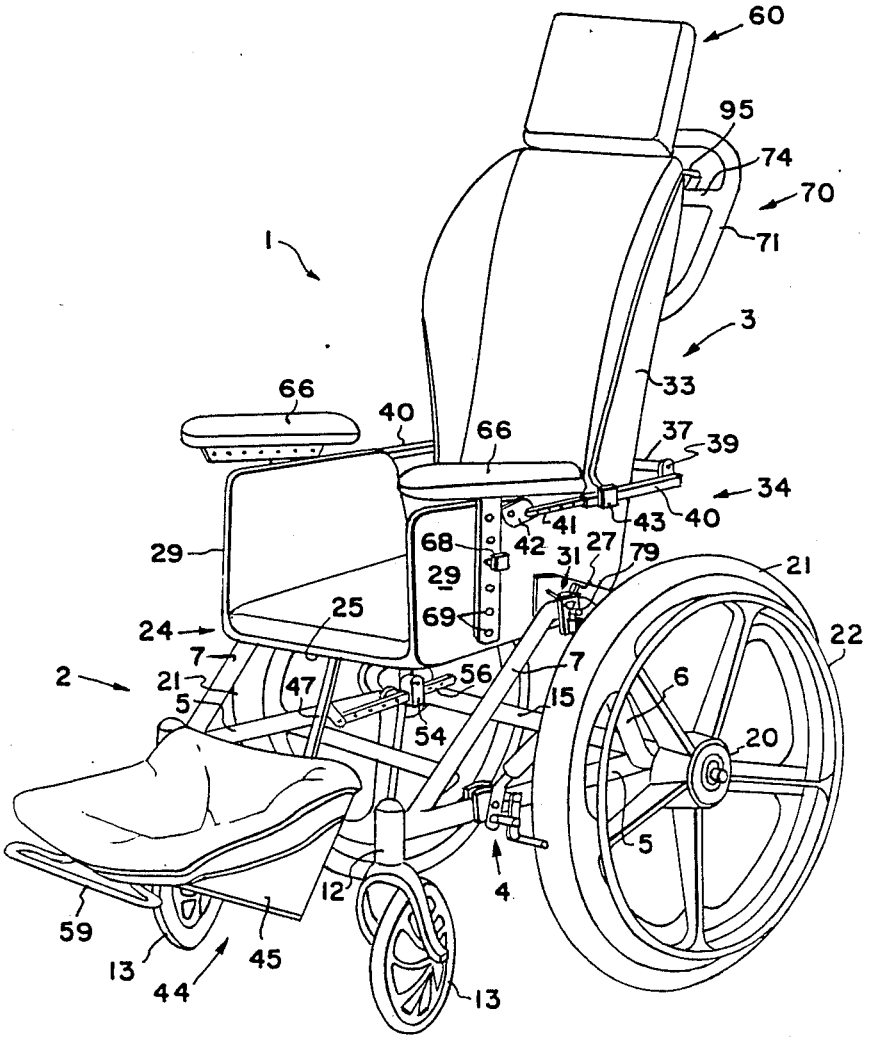
FIG. 1 is an isometric view of a completely assembled chair.

A chair constructed in accordance with the preferred embodiment of the invention is designated generally by the reference character 1 and comprises a wheeled frame 2 and a body support assembly 3 removably carried by the frame. The frame comprises a pair of identical side members 4 each of which has longitudinally extending, horizontal members 5 from opposite ends of which upwardly extending members 6 and 7 converge and are joined by a short, horizontal connector 8.

Extending tranversely of and connecting the two frame members 4 is a forward cross member 9. The horizontal members 5 have extensions 11 at their forward ends which support bushings 12 in which swivelable wheels 13 are mounted. Each frame member 5 is hollow, at least at its rearward end, for the slideable accommodation of a rod 14 (FIG. 10) the outer end of which is secured to a transversely extending, tubular cross member 15 which spans and projects beyond the frame members 5. Each of the rods 14 is secured in a selected position of adjustment relative to the associated frame member 5 by a set screw 16.

Figure 10:
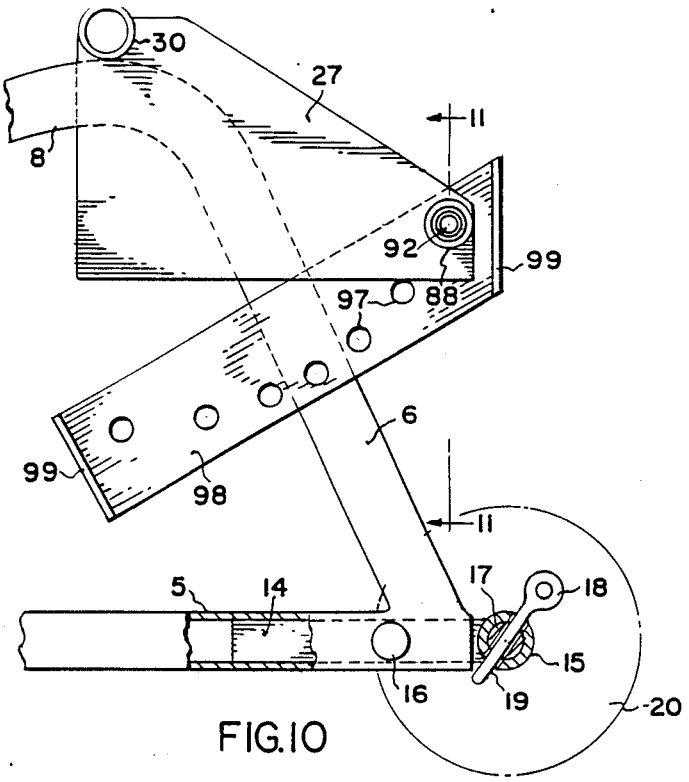
FIG. 10 is an enlarged, side elevational view, partly in section, illustrating details of the construction.

Slideably accommodated within each end of the cross member 15 is a stub shaft 17. Each stub shaft is removably maintained in the cross member 15 by a pin 18 having a shank 19 which extends through aligned openings in the members 15 and 17, as is best shown in FIG. 10.

The outer end of each stub shaft 17 has fixed thereto a hub 20 on which is journalled a relatively large diameter wheel 21. A ring 22 is carried by each wheel in a position to be engaged by a person's hand so as to enable the occupant of the chair to propel the latter manually.

The body support assembly 3 is straddled by the side frames 4 and and comprises a seat member 24 having a bottom 25 fixed to a supporting cradle 26 that terminates at its opposite ends in upstanding flanges 27. The seat bottom 25 is rigid and has upstanding, rigid sides 29 adjacent the flanges 27. Each of the flanges 27 of the cradle is provided with a laterally extending coupling or bearing 30 that is removably and pivotably accommodated in a socket member 31 fixed on the adjacent frame bar 8. The members 30 and 31 will be referred to in more detail hereinafter.

The back member 3 comprises the rigid panel 32 having forwardly projecting sides 33. The panel 32 is fixed to frame members 34 (FIG. 5) connected at their lower ends to the cradle 26 of the seat 25 by pivot pins 35. The back member 3 thus is capable of rocking about the substantially horizontal axes of the pivot pins 35 between an upright, generally vertical position as shown in chain lines in FIG. 2 to any one of a number of different rearwardly inclined positions, one of which is shown in full lines in FIG. 2.

Adjustable retaining means 36 is provided for retaining the back member 3 in a selected position of adjustment relative to the seat member 24 and comprises a cross bar 37 (FIG. 5) welded or otherwise suitably fixed to the frame members 34 and through which extends an anchor rod 38 pivoted as at 39 to tubes 40 in each of which is slideably accommodated one end of an adjusting rod 41, the opposite end of which is pivoted by a link 42 to the adjacent side 29 of the seat member. A set screw 43 reacts between the tube 40 and the rod 41 to maintain the back member 3 in whatever position of angular adjustment relative to the set is desired.

The chair construction preferably includes a foot rest member 44 comprising an L-shaped body 45 having a bracket 46 which slideably accommodates one leg 47 of a two-legged support 48, the opposite leg 49 of which is slidably accommodated in a tube 50 secured to the bottom of the seat member 24. A set screw 51 maintains the body 45 in any selected position of vertical adjustment relative to the leg 47, and a similar set screw 52 maintains the leg 49 in any selected position of adjustment fore and aft of the seat.

The legs 47 and 49 of the support 48 preferably are joined to one another by a pivot 53 to enable the included angle between the legs to be adjusted. Such angle may be maintained by means of a tubular bracket 54 pivoted to a link 55 fixed on the seat member 24 and a rod 56 pivoted at one end to a link 57 secured to the leg 47 and having its other end slideably accommodated in the bracket 54. A set screw 58 reacts between the members 54 and 56 to maintain them in selected positions of adjustment. It is possible, therefore, to adjust the foot rest 44 to any one of a number of different positions as is indicated in full and chain lines in FIG. 2. A bumper 59 preferably is secured to the foot rest at its forward end.

A vertically adjustable head rest 60 is included and comprises a support member 61 secured to a rectangular tube 62 that is slideably accommodated in a bracket 63. The support member 61 is vertically adjustable relative to the back panel 32 and may be maintained in a selected position of adjustment by means of a set screw 64.

Each side member 29 of the seat is provided with a vertically adjustable support 65 that is fixed at its upper end to a padded arm rest 66. An anchor screw 68 passes through a selected one of a number of vertically spaced openings 69 in the support 65 and is threaded into a threaded socket carried by the side member 29 so as to support each arm rest at a selected height.

To facilitate movement of the chair 1 by an attendant, a handle assembly 70 is provided and includes a generally rectangular frame 71 having an upper cross bar 72 adapted to be gripped by the attendant and a lower cross bar 73 that is welded or otherwise suitably fixed to the back frame members 34. The handle assembly also includes an intermediate cross bar 74 for a purpose presently to be explained.

As mentioned earlier, each side flange 27 of the seat supporting cradle 26 is provided with a laterally projecting stud or bearing 30 and the upper member 8 of each side frame 4 is provided with a socket member 31. Each socket member 31 has a pair of forward and rearward members 75 and 76 the upper portions of which diverge upwardly, as is best shown in FIG. 7. The lower portions of the members 75 and 76 are spanned by and secured to a side plate 77 which also is welded or otherwise secured to the frame member 8. Adjacent its lower level each side plate 77 is provided with an open ended tube 78.

The fore and aft spacing between the members 75 and 76 is sufficient to accommodate the stud or bearing 30 of the adjacent flange 27 and the transverse spacing between the two socket members corresponds to that between the two bearings 30. The seat 24, therefore, bodily can be introduced to and removed from the socket members 31 when desired.

To prevent inadvertent removal of the seat from the socket members, a retaining pin 79 is fixed at the free end of one leg 80 of a U-shaped spring 81, the opposite leg 82 of which is reversely turned and accommodated in the tube 78. When the spring 81 is in the position shown in FIG. 8, the pin 79 has its nose 83 projected through an opening 84 into the hollow bearing 30. However, the nose 83 may be withdrawn from the bearing 30 and the pin 79 moved downwardly in the tube 78, as is shown in FIG. 9, to permit removal of the bearings 30 from their respective socket members and, consequently, bodily removal of the body support from the base frame 2.

Figure 2:
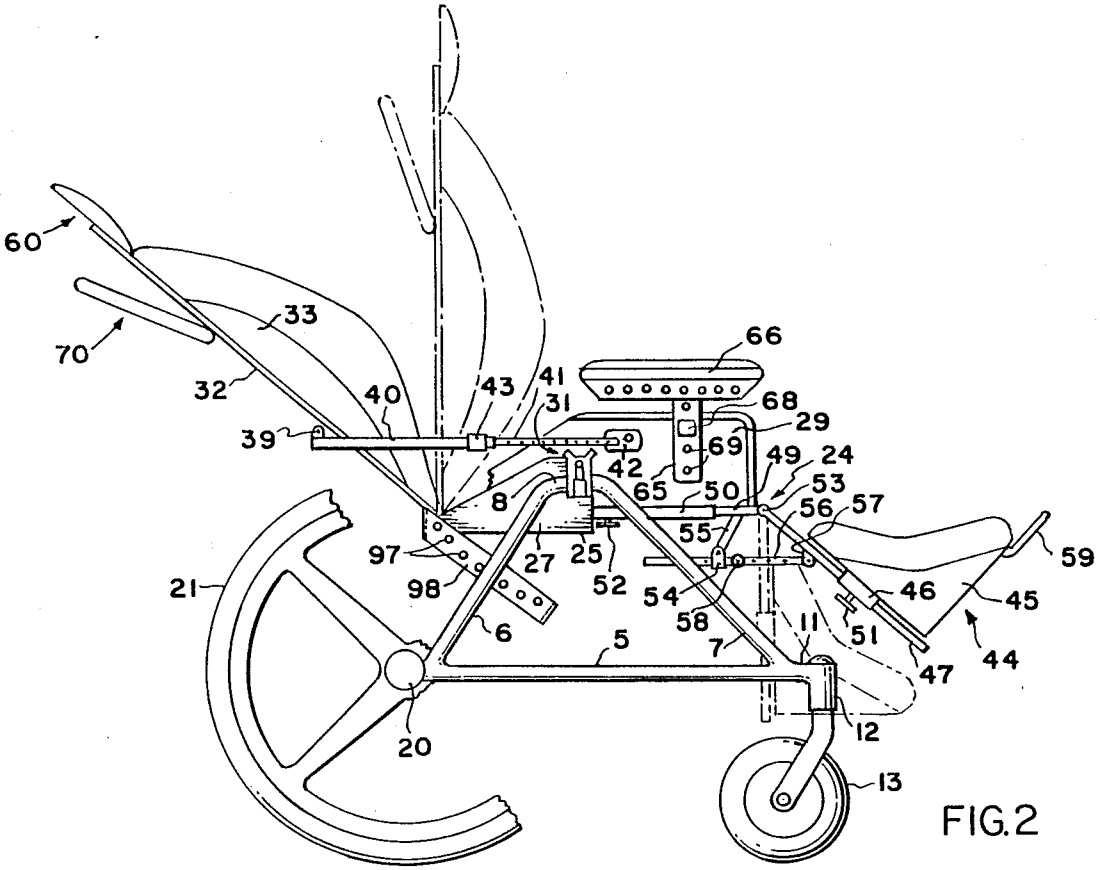
FIG. 2 is a side elevational view, with parts broken away, and illustrating the back member in two adjusted positions.
Figure 4:
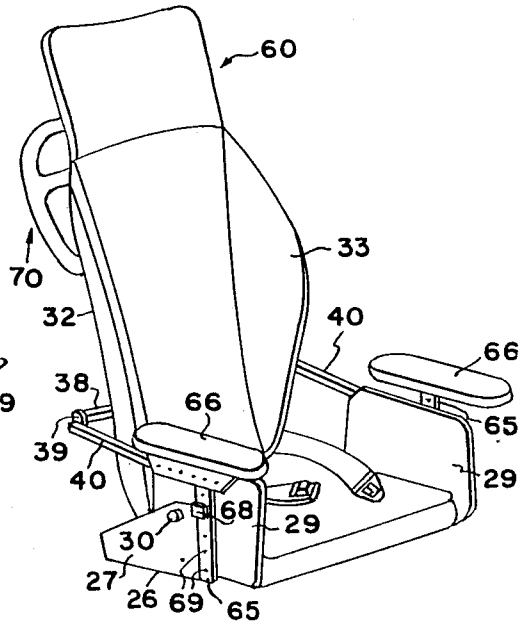
FIG. 4 is an isometric view of the seat and back members only.
Figure 3:
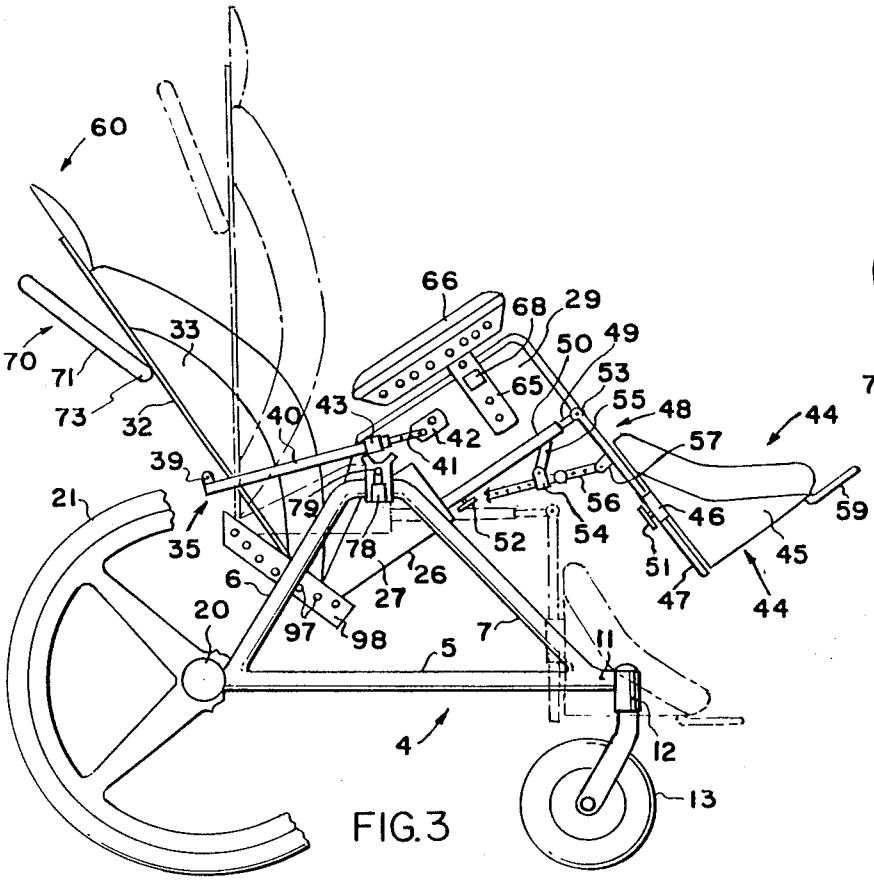
FIG. 3 is a view similar to FIG. 2, but illustrating the seat, back, and foot rest members in two different positions.

The bearings 30 and socket members 31 not only enable bodily removal of the body support 3 from the frame 2, but also enable the entire body support to be rocked or tilted as a unit about the substantially horizontal axes of the bearings 30. This characteristic of the construction is best shown in FIGS. 2 and 3. In FIG. 2, the body support 3 is shown with its seat member 24 in a substantially horizontal position, whereas in FIG. 3 the seat member 24 is shown as having been rocked counterclockwise to a rearwardly tilted position. The back member and foot rest rock with the seat member.

Figure 11:
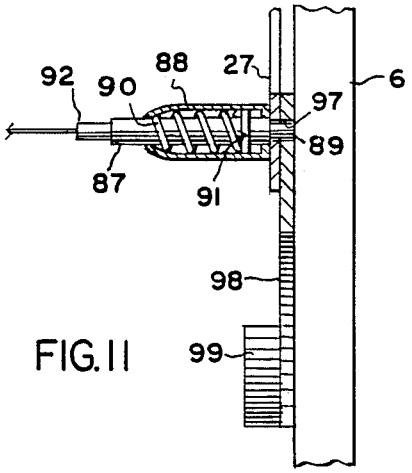
FIG. 11 is an enlarged sectional view taken on the line 11—11 of FIG. 10.

Releasable latch means designated generally by the reference character 86 (FIG. 5) is provided to latch the support 3 in any selected position of tilted adjustment. The latch means comprises a pair of pins 87 (see FIG. 11) which extend through housings 88 fixed to the side flanges 27 of the cradle 26. Each pin 87 has a reduced diameter nose 89 that projects through an opening in the adjacent flange 27 and each pin is biased to its projected position by a spring 90 which reacts between one end of the housing 88 and a flange 91 secured to the pin. Each pin 87 is fixed at its opposite end to one end of a flexible cable 92 which passes through a bushing 93 (FIG. 5) supported on the frame members 34 and has its opposite end fixed to a leg 94 of a U-shaped actuator 95 that is reciprocal in guides 96 which are fixed to and extend through openings in the cross bar 74 of the handle member 60. Upward movement of the actuator 95 from the position shown in FIG. 5 will cause the cables 92 to retract the noses 89 of the pins 87 into the housings 88.

The nose 89 of each latch pin 87 may be projected into any one of a number of openings 97 formed in a retainer plate 98, one of which is welded or otherwise fixed to the rear upright 6 of each side frame 4. The openings 97 are substantially uniformly spaced from one another and are formed on the arc of a circle having its center at the associated bearing 30.

To rock the body support 3 relative to the frame 2, the noses 89 of the latch pins are withdrawn from their respective openings 97 in the retainer plates 98, whereupon the body support may be rocked to the desired position. Thereupon, the actuator 95 may be released, whereupon the springs 90 will project the latch pins in a direction to enable their noses to enter the adjacent openings 97. The body support 3 then will be retained in its adjusted position.

At each end of each retainer plate 98 is a flange 99 which is engageable with the flange 27 to prevent excessive tilting of the body support relative to the frame.

A particularly advantageous characteristic of the construction is that the seat member, the back member and the foot rest are adjustable relatively to one another so as to enable the angles between an occupant's back, thighs, and lower legs to be adjusted as desired. In addition, the entire body support, consisting of the seat member, the back member, and the foot rest, may be tilted bodily relatively to the frame while maintaining the angulation between the back member and the seat member and between the seat member and the foot rest.

If it should be desired to remove the body support 3 from the frame 2, it is possible to do so simply by withdrawing the retaining pins 79 from the bearings 30 and withdrawing the noses 89 of the latch pins 87 from the openings in the retainer plates 98. The entire body support assembly then may be lifted off the frame and placed on a vehicle's seat, the floor, or any other place desired. When the body support is removed from the wheeled frame, the seat member and the back member may be adjusted relatively to one another and the foot rest may be adjusted relatively to the seat member or, if preferred, the foot rest may be removed from the seat member.

The latch plates 98 are shown in phantom lines in FIG. 5 to illustrate the flanges 99, but it will be understood that the plates 98 are not removable from the frame 2 with the body support 3.

In those instances in which the body support 3 is rocked the maximum permissible distance counterclockwise from the position shown in FIG. 2, it may be desirable to extend the rear wheels 21 rearwardly to provide greater stability for the tilted body support. This may be accomplished by loosening the set screws 16 and sliding the rear cross bar 15 rearwardly to the desired position, following which the set screws may be reset.

The disclosed embodiment is representative of a presently preferred form of the invention, but is intended to be illustrative rather than definitive thereof. The invention is defined in the claims.

We claim:

1. An incapacitated person's chair construction comprising frame means; body support means having a seat member and a back member; hinge means coupling said seat and back members to one another; and pivot means rockably connecting said support means to said frame means, said hinge means enabling relative pivotal movement of said seat and back members and said pivot means enabling conjoint tilting of said seat and back members relative to said frame means, said pivot means being separable enabling separation of said support means and said frame means.

2. The construction according to claim 1 including wheel means, and mounting means mounting said wheel means on said frame means.

3. The construction according to claim 2 wherein said mounting means is adjustable relative to said frame means.

4. The construction according to claim 1 including latch means for releasably latching said support means in any selected one of a number of different tilted positions relative to said frame means.

5. The construction according to claim 4 wherein said latch means comprises a retainer carried by said frame means and a latch pin carried by said support means for movements into and out of latching engagement with said retainer.

6. The construction according to claim 5 including means coupled to said latch pin for moving the latter relative to said retainer.

7. The construction according to claim 1 wherein said pivot means comprises a socket carried by said frame means and a bearing carried by said support means, said bearing being removably and rotatably accommodated in said socket.

8. The construction according to claim 7 including retainer means removably retaining said bearing in said socket.

9. The construction according to claim 1 including a foot rest one end of which is pivotally connected to said seat member.

10. The construction according to claim 9 including means for removably securing said foot rest in a selected position of pivotal adjustment relative to said seat member.

11. The construction according to claim 9 including an arm rest, and means adjustably securing said arm rest to said seat member.

12. The construction according to claim 1 including a head rest, and means adjustably securing said head rest to said back member.

13. An incapacitated person's chair construction comprising frame means; body support means having a seat member and a back member; hinge means coupling said seat and back members to one another; and pivot means rockably connecting said support means to said frame means, said hinge means enabling relative pivotal movement of said seat and back members and said pivot means enabling conjoint tilting of said seat and back members relative to said frame means, said frame means comprising a pair of spaced apart frame members straddling said support means, said frame members being joined by forward and rearward cross members, rear wheels journalled on said frame members, and forward wheels journalled on said frame members, said rear wheels being adjustable fore and aft of said frame members.

14. The construction according to claim 13 wherein said rear wheels are journalled on said rearward cross member and including means for releasably securing said rearward cross member in a selected position of fore and aft adjustment relative to said frame members.

15. The construction according to claim 13 wherein said rear wheels are removable from said frame members, and means for removably retaining said rear wheels on said frame members.

16. An incapacitated person's chair construction comprising support means having a set member and a back member; frame means straddling said support means; coupling means extending laterally from opposite sides of said support means and rockably coupling said support means to said frame means, thereby enabling tilting movements of said support means relative to said frame means about a substantially horizontal axis; and releasable latch means reacting between said frame means and said support means for releasably latching said support means in any selected one of a number of different tilted positions relative to said frame means, said coupling means being separable from said frame means for enabling separation of said support means from said frame means.

17. The construction according to claim 16 wherein said coupling means comprises a pair of sockets carried by said frame means and a pair of bearings carried by said support means and accommodated in respective ones of said sockets.

18. The construction according to claim 17 wherein said coupling means includes releasable retaining means reacting between said frame means and said support means for removably retaining said bearings in the respective sockets.

19. The construction according to claim 16 wherein said seat member and said back member are hinged to one another for pivotal movements relative to one another.

20. The construction according to claim 19 including a foot rest and means connecting said foot rest to said support means.

21. The construction according to claim 20 wherein said foot rest is adjustable relative to said support means, and means for securing said foot rest in a selected position of adjustment relative to said support means.

22. The construction according to claim 16 wherein said latch means comprises at least one retainer plate secured to said frame means at one side of said support means, said plate having a plurality of spaced openings therein, an extensible and retractable latch pin carried by said support means and confronting said latch plate for projection toward and accommodation in any selected one of said openings, and actuating means connected to said pin for retracting it from the selected opening.

23. The construction according to claim 22 wherein said retainer plate, said latch pin, and said actuating means are duplicated at the opposite side of said frame means and said support means.

24. The construction according to claim 23 wherein said actuating means effects simultaneous retraction of said pins from the respective openings.

25. The construction according to claim 22 including spring means resiliently biasing said pin to its projected position.

26. An incapacitated person's chair construction comprising frame means; body support means having a seat member and a back member; hinge means coupling said seat and back members to one another for enabling said seat and back members to assume a selected one of a plurality of angularly adjusted positions relative to one another; and coupling means independent of said hinge means and rockably coupling said body support means to said frame means for enabling rocking movements of said body support means relative to said frame means while said seat and back members remain in said selected one of said positions.

27. The construction according to claim 26 including latch means for releasably latching said body support means in a selected one of a number of adjusted positions relative to said frame means.

28. The construction according to claim 26 wherein said coupling means is separable for enabling said body support means to be removed from said frame means.

29. The construction according to claim 26 including forward and rearward sets of wheels, and means mounting said sets of wheels on said frame means.

30. The construction according to claim 29 wherein the mounting means for at least one of said sets of wheels enables relative adjustment of said sets of wheels toward and away from one another.

31. The construction according to claim 26 wherein said body support means foot rest means, and means pivotally connecting said foot rest means to said seat member.

* * * * *

UNITED STATES PATENT AND TRADEMARK OFFICE

CERTIFICATE OF CORRECTION

PATENT NO. : 4,893,827

DATED : January 16, 1990

INVENTOR(S) : Dwight S. Gay; John W. Hoornstra

It is certified that error appears in the above-identified patent and that said Letters Patent is hereby corrected as shown below:

In column 1, line 45, "doctors'offices" should be changed to -- doctors' offices --.

In column 7, line 23, "set" should be changed to -- seat --.

In column 8, line 52, after "means" (first occurrence) insert --includes--

Signed and Sealed this

First Day of January, 1991

*Attest:*

HARRY F. MANBECK, JR.

*Attesting Officer*

*Commissioner of Patents and Trademarks*